US009435352B2

(12) United States Patent
Twell

(10) Patent No.: US 9,435,352 B2
(45) Date of Patent: Sep. 6, 2016

(54) DRIVE LEVER ARRANGEMENT

(75) Inventor: Philip Twell, Welton (GB)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 401 days.

(21) Appl. No.: 14/115,347

(22) PCT Filed: Apr. 24, 2012

(86) PCT No.: PCT/EP2012/057483
§ 371 (c)(1),
(2), (4) Date: Nov. 19, 2013

(87) PCT Pub. No.: WO2012/156180
PCT Pub. Date: Nov. 22, 2012

(65) Prior Publication Data

US 2014/0064875 A1 Mar. 6, 2014

(30) Foreign Application Priority Data

May 18, 2011 (EP) ..... 11166595

(51) Int. Cl.
*F04D 29/60* (2006.01)
*F01D 17/16* (2006.01)
*F01D 17/10* (2006.01)

(52) U.S. Cl.
CPC ..... *F04D 29/60* (2013.01); *F01D 17/10* (2013.01); *F01D 17/162* (2013.01); *F05D 2260/30* (2013.01); *F05D 2260/50* (2013.01); *Y10T 29/49321* (2015.01); *Y10T 29/49959* (2015.01)

(58) Field of Classification Search
CPC ..... Y10T 403/7091; Y10T 403/587; F16B 21/12; F16B 21/125; F01D 17/10; F01D 17/162; F05D 2260/30; F05D 2260/50; F04D 29/60
See application file for complete search history.

(56) References Cited

U.S. PATENT DOCUMENTS

| | | | | |
|---|---|---|---|---|
| 2,999,630 | A | 9/1961 | Nagel | |
| 3,356,288 | A | 12/1967 | Corsmeier | |
| 3,954,349 | A * | 5/1976 | Abild | F01D 17/162 415/160 |
| 4,979,874 | A | 12/1990 | Myers | |
| 5,314,301 | A * | 5/1994 | Knight | F01D 5/148 415/160 |
| 5,492,446 | A | 2/1996 | Hawkins | |
| 6,634,843 | B1 * | 10/2003 | Tarnow | F16B 21/12 403/155 |

(Continued)

FOREIGN PATENT DOCUMENTS

| | | | |
|---|---|---|---|
| FR | 2599785 | A1 | 12/1987 |
| GB | 837649 | A | 6/1960 |
| JP | 60198306 | A | 10/1985 |

OTHER PUBLICATIONS http://en.wikipedia.org/wiki/R_clip.

*Primary Examiner* — Robert Canfield
(74) *Attorney, Agent, or Firm* — Beusse Wolter Sanks & Maire

(57) ABSTRACT

A drive lever arrangement is provided. The drive lever arrangement includes a unison ring which has a groove; a drive lever having connection means for connecting the drive lever to the unison ring; a drive lever pin having a transversal throughbore hole; and a clip, wherein the drive lever pin connects the drive lever to the unison ring, and wherein the clip is inserted in the groove through the throughbore hole of the drive lever pin, and engages with the groove of the unison ring.

16 Claims, 5 Drawing Sheets

(56) References Cited

U.S. PATENT DOCUMENTS 6,802,692 B2 10/2004 Bouru
7,112,041 B2 * 9/2006 Debeneix ..... F01D 17/162 415/160
7,306,275 B2 * 12/2007 Kalous ..... B60D 1/06 296/1.07
8,714,916 B2 * 5/2014 Jarrett, Jr. ..... F01D 17/162 415/160
9,090,136 B2 * 7/2015 Breeden ..... B60D 1/06

* cited by examiner

DRIVE LEVER ARRANGEMENT

CROSS REFERENCE TO RELATED APPLICATIONS

This application is the US National Stage of International Application No. PCT/EP2012/057483 filed Apr. 24, 2012, and claims the benefit thereof. The International Application claims the benefit of European Application No. EP 11166595.6 filed May 18, 2011. All of the applications are incorporated by reference herein in their entirety.

FIELD OF INVENTION

The invention relates to a drive lever arrangement. The invention further relates to a method of placing a drive lever pin in a drive lever arrangement. Moreover, the invention relates to a use of an R-shaped clip in a drive lever arrangement.

BACKGROUND

In general, a gas turbine comprises vanes which are connected via a drive lever to a unison ring. The unison ring with its lever arrangement is typically found in the compressor section of the gas turbine, but may also be used in the turbine section of the gas turbine, e.g. the power turbine section. Possible connection means for connecting the drive lever to the unison ring are nuts and bolts, screwed hinge pins or secured pins, in particular cir-clip secured pins.

U.S. Pat. No. 4,979,874 discloses a variable vane drive mechanism, particularly discloses a drive arm lever which extends from the unison ring to a post at the outward end of a corresponding trailing edge segment. Each lever arm has a vane post end and a unison ring end. The unison ring end of each lever arm is attached to the unison ring by means, such as a bolt and a nut. The unison ring end of the lever arm is rotatable about the bolt.

U.S. Pat. No. 5,492,446 discloses a self-aligning variable stator vane including an airfoil with an integral outer trunnion having a seat extending integrally therefrom. A threaded stem extends from the seat and includes a coextensive alignment surface that cooperates with a complementary mounting hole in a lever arm which restrains rotation of the lever arm about the stem during assembly for ensuring a predetermined rotational orientation between the lever arm and the airfoil.

U.S. Pat. No. 6,802,692 discloses a device for controlling a variable-angle vane for a stator of a turbomachine compressor. The device comprises a link, connection means forming a hinge between a first end of the link and a control ring, fixing means for fixing a second end of the link on a pivot of a vane to be controlled, and pinch means acting transversely relative to a longitudinal midplane of the link to lock the second end of the link in rotation without slack on the pivot.

U.S. Pat. No. 3,356,288 discloses an axial flow compressor comprising an outer casing, inner frame members, and adjustable compressor stages. Each stage comprises a row of stator blades and a row of rotating compressor blades. The stator blades are each mounted by stud shafts journaled in the outer casing and inner frame respectively for pivotal movement about an axis extending radially from the center of rotation of a rotor. An end of a lever arm is secured to each stud and the other end of the lever arm is secured in an actuator ring using a pin which is retained on the actuator ring by a snap ring.

GB 837,649 discloses an axial-flow compressor having radially directed stator blades mounted on a casing for rotation about their axes by means of actuating rings encircling the casing and connected by levers to the bases of the blades. The rings are connected to the levers by universal joints, and the levers are secured to the bases of the blades, relative rotation between the levers and their blades being prevented by tangs on the bases received within openings in the levers.

There may be a need to provide a drive lever arrangement and method of placing a drive lever pin in a drive lever arrangement that allows for a quick and easy assembling and disassembling of parts of the drive lever arrangement, e.g. for maintenance and service.

SUMMARY OF THE INVENTION

In order to meet the need defined above, a drive lever arrangement, a method of placing a drive lever pin in a drive lever arrangement, and a use of an R-shaped clip in a drive lever arrangement according to the independent claims are provided.

According to an exemplary aspect, a drive lever arrangement is provided, wherein the drive lever arrangement comprises a unison ring which comprises a groove, a drive lever comprising connection means for connecting the drive lever to the unison ring, a drive lever pin comprising a transversal throughbore hole, and a clip, wherein the drive lever pin connects the drive lever to the unison ring, and wherein the clip is inserted in the groove through the throughbore hole of the drive lever pin, and engages with the groove of the unison ring.

The drive lever arrangement may be a drive lever arrangement of a turbine, in particular a turbine with a variable guide vane mechanism. In particular, the unison ring may comprise a body or compact portion. The compact portion of the unison ring may extend as a massive body in the axial direction and the radial direction of the unison ring and may form the main body of the unison ring. In particular, the groove may be formed in or at the compact portion of the unison ring, so that the groove may extend along the axial direction of the unison ring and along the radial direction of the unison ring as well. That is, the groove may be a circumferential groove so that a cross section through the unison ring may roughly form a U or W shape. Furthermore, a dimension of the groove along the axial direction of the unison ring may be greater than a dimension of the groove along the radial direction. That is, the depth of the groove may be greater than the width of the groove.

In particular, the transversal throughbore hole of the drive lever pin may be a throughbore hole in a transversal direction of the drive lever pin. For example, a transversal direction of the drive lever pin may be a direction perpendicular to the main axis of the drive lever pin, e.g. the radial direction of the drive lever pin.

For example, a clip which may be inserted through the throughbore hole of the drive lever pin, may be a cotter pin, a split pin, an R-clip or a hairpin pin. In particular, a cotter pin may be a pin with a loop on one end, and two sides which are inserted through a pin to be secured, for example the drive lever pin. The ends of the cotter pin are split and bent over to prevent the cotter pin from coming loose.

According to an exemplary aspect, a method of placing a drive lever pin in a drive lever arrangement is provided, wherein the drive lever arrangement comprises a unison ring comprising a groove, a drive lever comprising connection means for connecting the drive lever to the unison ring, and a drive lever pin comprising a transversal throughbore hole, wherein the method comprises connecting the drive lever to the unison ring with the drive lever pin, inserting an clip in the groove through the throughbore hole of the drive lever pin.

According to an exemplary aspect a use of an R-shaped clip in a drive lever arrangement is provided. In particular, according to an exemplary embodiment the drive lever arrangement may comprise a unison ring which comprises a groove, a drive lever comprising connection means for connecting the drive lever to the unison ring, a drive lever pin comprising a transversal throughbore hole, and a clip, e.g. the R-shaped clip, wherein the drive lever pin connects the drive lever to the unison ring.

In particular, the clip may be inserted in the groove through the throughbore hole of the drive lever pin, and engages with the groove of the unison ring. Additionally and/or alternatively, the drive lever pin may further comprise a circumferential collar element, wherein the circumferential collar element is adapted to engage with the groove, wherein the clip is inserted through the throughbore hole of the drive lever pin.

An advantage of the use of such a clip in a drive lever arrangement may be that the drive lever pin may be secured in such a way that a movement, e.g. a rotation of the drive lever pin is inhibited. If a rotation of the drive lever pin is inhibited a stability of a drive lever arrangement may be increased.

An R-shaped clip is a fastener made of a springy material, commonly hardened metal wire, resembling the shape of the letter "R". R-shaped clips are commonly used to secure the ends of round shafts such as axles. The straight leg of the R-clip is pushed into a hole near one end of the shaft until the semicircular "belly" in the middle of the other, bent leg of the R-clip grips one side of the shaft so that the R-clip is secured in the hole. To assist insertion the end of the bent leg is angled away from the straight leg. This angled end rides the side of the shaft and opens the "belly" mouth enough to pass the widest part of the shaft as the R-clip is inserted.

For maintenance or service reasons it may be necessary to remove parts of a drive lever arrangement, in particular unison rings and/or vanes. A connection between vanes and the unison ring by a drive lever pin may offer a quick and less intricate way of connecting the drive lever to the unison ring compared to a nut and bolt connection. However, pins may need to be secured in particular along the axial direction of the pin in order to prohibit a lateral movement of the pin and thus a loosening of the drive lever. For example, cir-clips or R-shaped clips may be used to secure pins. Also cotter pins, split pins, or hairpin pins may be used to secure pins.

An advantage of a split pin or a cotter pin over cir-clips may be that inserting a split pin or cotter pin through a transversal throughbore hole of the drive lever pin is less intricate than fitting a cir-clip around a shaft of the drive lever pin.

A particular advantage of an R-shaped clip over cir-clips may be that inserting a straight leg of an R-shaped clip through a transversal throughbore hole of the drive lever pin is less intricate than fitting a cir-clip around a shaft of the drive lever pin. Furthermore, parts of an assembled R-shaped clip may still be visible. Thus, it may be easily checked whether the R-shaped clip is assembled correctly so that the pin may be secured.

Next, further exemplary embodiments of the drive lever arrangement are described. However, these embodiments also apply to the method of placing a drive lever pin and the use of an R-shaped clip in a drive lever arrangement.

According to an exemplary embodiment of the drive lever arrangement the clip comprises a first leg and a bent second leg, wherein the first leg and the bent second leg are connected by a spring part.

In particular, the first leg may be a straight leg or a bent leg. For example, the spring part of the clip may be configured as a single spring or as a double spring. In particular, the bent second leg may be a curved leg. The first leg of the clip may be adapted to be put through the transversal throughbore hole of the drive lever pin. The bent second leg of the clip may be adapted to grip around an outer perimeter of the drive lever pin or match to the outer perimeter of the drive lever pin. The clip may prohibit loosening of the drive lever pin; in particular it may secure a radial position of the drive lever pin and may at the same time be secured to the pin due to the gripping or matching of the bent second leg.

According to an exemplary embodiment of the drive lever arrangement, wherein the bent second leg comprises a first region where a distance between the first leg of the clip and the bent second leg of the clip increases and a second region where the distance between the first leg of the clip and the bent second leg of the clip decreases.

In particular, the distance of the first leg and the bent second leg may diverge and converge in such a way that a gap between the first leg and the bent second leg is formed. More particularly, the gap between the first leg and the bent second leg may secure the drive lever pin. For example, an end of the bent second leg may be angled away from the first leg. This angled end may ride a side of a shaft of the drive lever pin and may open an opening or a mouth of the gap between the first leg and the bent second leg to pass an widest part of the shaft of the drive lever pin as the is inserted. In particular, the clip may be an R-shaped clip. A first or a straight leg of the R-shaped clip may be adapted to be put through the transversal throughbore hole of the drive lever pin. A bent second or a bent leg of the R-shaped clip may be adapted to grip around an outer perimeter of the drive lever pin or match to the outer perimeter of the drive lever pin. The R-shaped clip may prohibit loosening of the drive lever pin; in particular it may secure a radial position of the drive lever pin and may at the same time be secured to the pin due to the gripping or matching of the bent leg.

According to an exemplary embodiment of the drive lever arrangement the unison ring comprises a protrusion extending from a compact portion of the unison ring, and the protrusion comprises a hole which is adapted in such a way that the drive lever pin is insertable into the hole.

In particular, the protrusion may extend into the axial direction of the unison ring. Furthermore, the unison ring may have a further groove or second groove extending into the axial direction of the unison ring and forming, together with the first groove, a top rail, a middle rail and a bottom rail. A depth in the axial direction of the first groove may differ from a depth in the axial direction of the further or second groove. Moreover, one of the top rail, middle rail, and bottom rail, in particular the top rail, may form the protrusion extending from a compact portion of the unison ring. Each of the three protrusions may have a length or size in the axially direction, wherein the length of the top rail or top protrusion may be greater, equal, or smaller than the length of the middle rail or middle protrusion and/or bottom rail or bottom protrusion. In other words, in top view one may see the edge of the top rail as well as the edge of the middle rail. In particular, at least parts of the assembled R-shaped clip may be visible underneath the top rail. The fact that parts of the assembled R-shaped clip may still be visible underneath the top rail may make it obvious or verifiable whether the R-shaped clip is assembled correctly so that the pin may be secured in the hole of the unison ring.

In particular, the unison ring may comprise further holes, e.g. throughbore holes, through the top rail and/or the middle rail and/or the bottom rail, i.e. holes in the radial direction of the unison ring. The holes in the top rail, the middle rail, and the bottom rail may have different diameters.

According to an exemplary embodiment of the drive lever arrangement the drive lever pin comprises a head part, wherein the transversal throughbore hole is arranged in the head part of the drive lever pin.

In particular, the head part may have a different diameter than a rest or shaft part of the drive lever pin. For example, the head part may have a greater or smaller diameter than the shaft part.

According to an exemplary embodiment of the drive lever arrangement the drive lever pin further comprises a circumferential collar element, wherein the circumferential collar element is adapted to engage with the groove.

In particular, the circumferential collar element may be formed at or on the head part of the drive lever pin. In particular, the circumferential collar element may be arranged in an asymmetric way around the drive lever pin. For example, an extension of the circumferential collar element along a radial direction of the drive lever pin in one section may be greater than an extension of the circumferential collar element in a second section, leading to an asymmetric form or shape. Moreover, the circumferential collar element may be a tongue-like feature, e.g. a fin or a cantilever, which may be adapted to engage with the groove of the unison ring. A thickness of the circumferential collar element, e.g. in the direction of the axial direction of the drive lever pin, may be smaller than a thickness of the first groove.

The circumferential collar element may prohibit loosening of the drive lever pin, in particular it may secure a radial position of the drive lever pin. The clip, in particular an R-shaped clip, may secure the drive lever pin, e.g. may prohibit a turning of the drive lever pin. In particular, a drive lever pin with a circumferential collar element, which pin is secured by a clip against turning, may allow for a positive locking between the circumferential collar and the groove of the unison ring, so that the pin may not come loose due to vibrations.

According to an exemplary embodiment of the drive lever arrangement the circumferential collar element extends over an angle between 15 degrees and 315 degrees of the perimeter of the drive lever pin.

In particular, the circumferential collar element may extend over a circular sector defined by an angle between 25 degrees to 270 degrees, more particularly between 45 and 90 degrees. That is, the circumferential collar element may not form an element arranged at the complete perimeter but only at specific parts or portions. Thus, it may form a single or a series of protrusion(s) or projection(s) which may fit or engage with the groove of the unison ring.

According to an exemplary embodiment of drive lever arrangement the drive lever pin comprises an element for turning the drive lever pin.

In particular, the element for turning the drive lever pin may allow for a turning of the drive lever pin either by hand or by a specific tool. For example, the element for turning the drive lever pin may be a handle; more particularly parts of the drive lever pin may be formed to be tightened or loosened by hand, e.g. a thumbscrew or a wing nut.

Next, further exemplary embodiments of the method of placing a drive lever pin are described. However, these embodiments also apply to the drive lever arrangement and the use of an R-shaped clip in a drive lever arrangement.

According to an exemplary embodiment of the method of placing a drive lever pin in a drive lever arrangement the drive lever pin comprises a circumferential collar element, and the method further comprises turning the drive lever pin so that the circumferential collar element of the drive lever pin engages in the groove of the unison ring.

BRIEF DESCRIPTION OF THE DRAWINGS

The aspects defined above and further aspects of the invention are apparent from the examples of embodiment to be described hereinafter and are explained with reference to these examples of embodiment.

The invention will be described in more detail hereinafter with reference to examples of embodiment but to which the invention is not limited.

DETAILED DESCRIPTION

Figure 1:
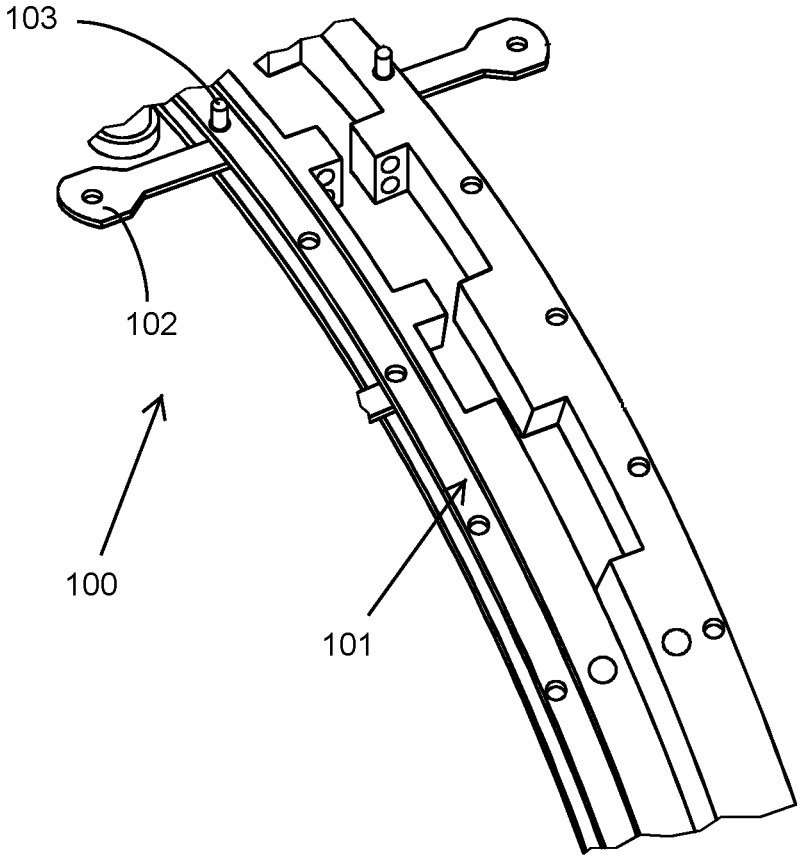
FIG. 1 schematically shows a drive lever arrangement according to exemplary embodiment.

The illustration in the drawing is schematically. In different drawings, similar or identical elements are provided with the similar or identical reference signs.

FIG. 1 schematically shows a drive lever arrangement 100 according to an exemplary embodiment wherein the drive lever arrangement 100 comprises a unison ring 101, a drive lever 102 and a drive lever pin 103.

In the following, referring to FIG. 2 and FIG. 3, a drive lever arrangement and a cross section of the drive lever arrangement according to an exemplary embodiment will be explained. The drive lever arrangement shown in FIG. 2 and FIG. 3 comprises a unison ring 101, wherein the unison ring 101 comprises a first groove 201 and a second groove 202. The first groove 201 and the second groove 202 form together a top protrusion or top rail 212, a middle protrusion or middle rail 211 and a bottom protrusion or bottom rail 210. In particular, the top rail 212, the middle rail 211 and the bottom rail 210 extend from a compact portion 209 of the unison ring 101 into the axial direction of the unison ring 101. A depth in the axial direction of the unison ring 101 of the first groove 201 differs from a depth of the second groove 202. In FIG. 3 is shown that a length of the top rail 212 is less than the length of the middle rail 211 and bottom rail 210.

Figure 2:
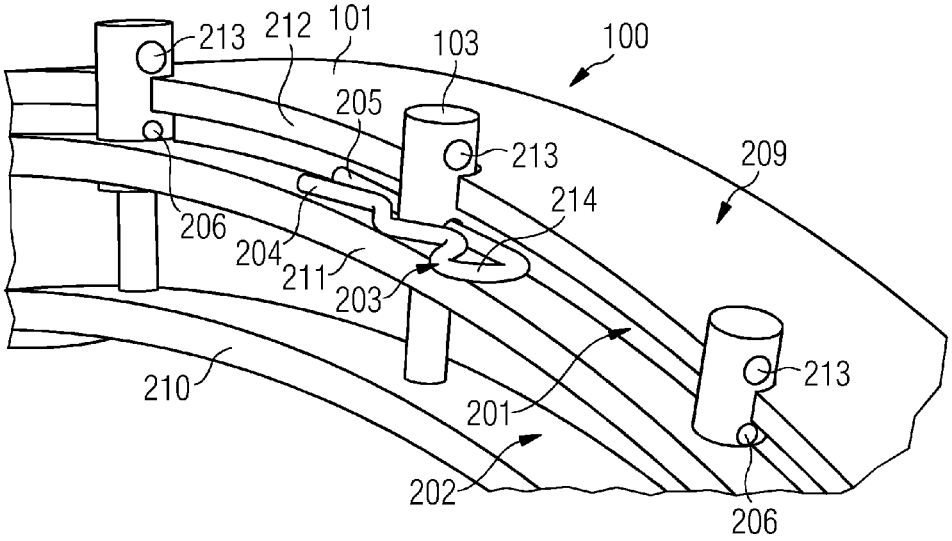
FIG. 2 schematically shows a section of a drive lever arrangement according to an exemplary embodiment.
Figure 3:
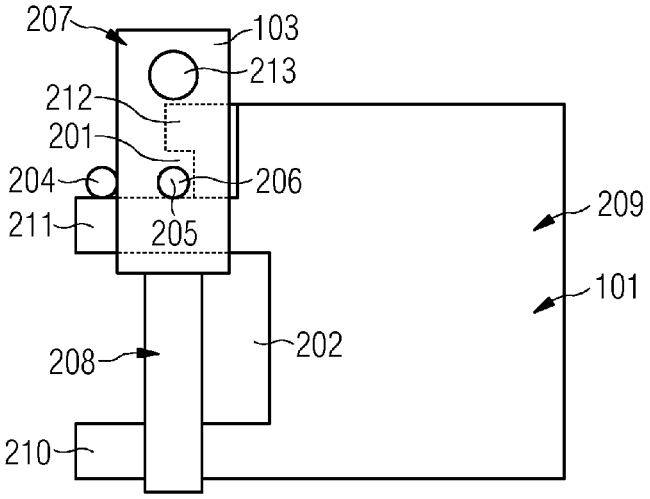
FIG. 3 schematically shows a cross section of the drive lever arrangement shown in FIG. 2.

Furthermore, FIG. 2 and FIG. 3 show a drive lever pin 103 which is inserted into the unison ring 101. In particular, the drive lever pin 103 is inserted through throughbore holes in the top rail 212 and the middle rail 211 and bottom rail 210, wherein the holes in the top rail, the middle rail, and the bottom rail have different diameters. The drive lever pin comprises a head part 207 and a shaft part 208, wherein the head part 207 of the drive lever pin 103 has a different diameter than the shaft part 208 of the drive lever pin. The head part 207 of the drive lever pin 103 further comprises transversal throughbore holes 206 and 213. FIGS. 2 and 3 show further a part of an R-shaped clip 203 inserted through one of the transversal throughbore holes 206 of the drive lever pin 103. The R-shaped clip 203 comprises a straight leg 205 and a bent leg 204 which are connected by a spring part 214. As it is shown in FIG. 2 the straight leg 205 of the R-shaped clip 203 is inserted through the transversal throughbore hole 206 of the drive lever pin 103, whereas the bent leg 204 of the R-shaped clip 203 grips around the drive lever pin 103. FIG. 2 and FIG. 3 show that the length of the top rail 212 is smaller than the length of the middle rail 211. This allows that at least parts of the bent leg are still visible underneath the top rail from atop, this making it obvious that the R-shaped clip 203 is assembled correctly so that the drive lever pin 103 is secured in the hole of the unison ring 101.

In the following, referring to FIG. 4 and FIG. 5, a drive lever arrangement and a cross section of the drive lever arrangement according to another exemplary embodiment will be explained. The drive lever arrangement shown in FIG. 4 and FIG. 5 comprises a unison ring 101 with a first groove 201 and a second groove 202 which form together a top rail 212, a middle rail 211 and a bottom rail 210.

Figure 4:
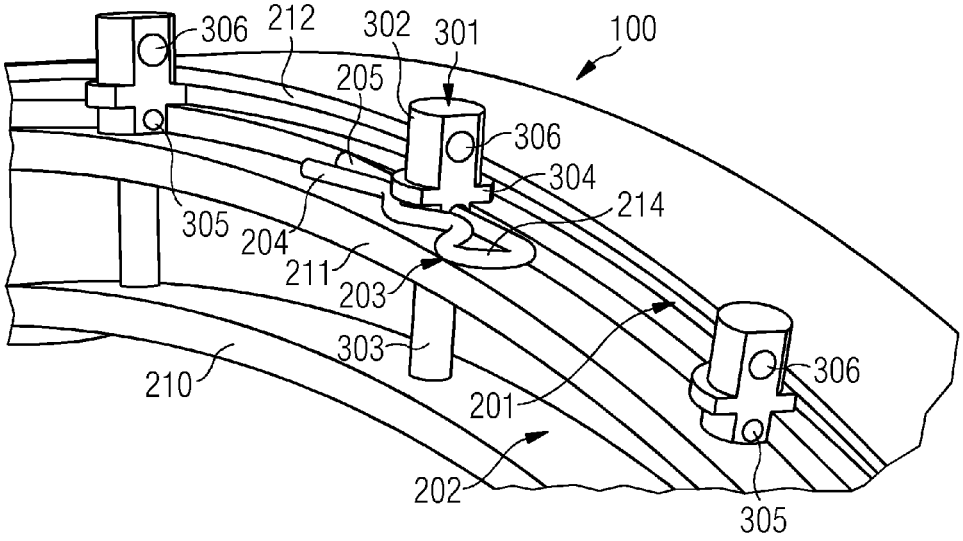
FIG. 4 schematically shows a section of a drive lever arrangement according to an exemplary embodiment.
Figure 5:
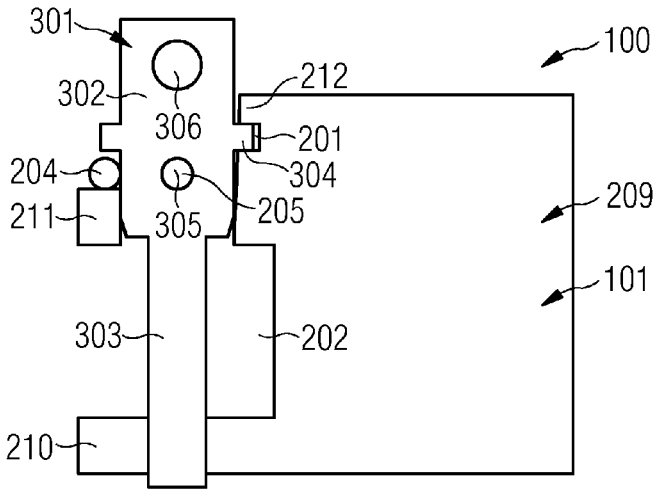
FIG. 5 schematically shows a cross section of the drive lever arrangement shown in FIG. 4.

Furthermore, FIG. 4 and FIG. 5 show a drive lever pin 301 which is inserted into the unison ring 101. In particular, the drive lever pin 301 is inserted through throughbore holes in the top rail 212 and the middle rail 211 and bottom rail 210. The drive lever pin 301 comprises a head part 302 and a shaft part 303, wherein the head part 302 of the drive lever pin 301 has a different diameter than the shaft part 303 of the drive lever pin 301. The head part 302 of the drive lever pin 301 also comprises transversal throughbore holes 305 and 306. Furthermore, the head part 302 of the drive lever pin 301 comprises a collar element 304. In particular, the circumferential collar element 304 is arranged in an asymmetric way around the head part 302 of the drive lever pin 301. That is, the circumferential collar element 304 does not form an element arranged at the complete perimeter but only at specific parts or portions. Moreover, the circumferential collar element 304 is adapted to engage with the first groove 201 of the unison ring 101. A thickness of the circumferential collar element 304, e.g. in the direction of the axial direction of the drive lever pin 301, is smaller than a thickness of the first groove 201. In particular, the transversal throughbore hole 306, may allow for a turning of the drive lever pin 301 by a specific tool, or may be used for insertion of another clip or another fixing or securing element.

Figure 6:
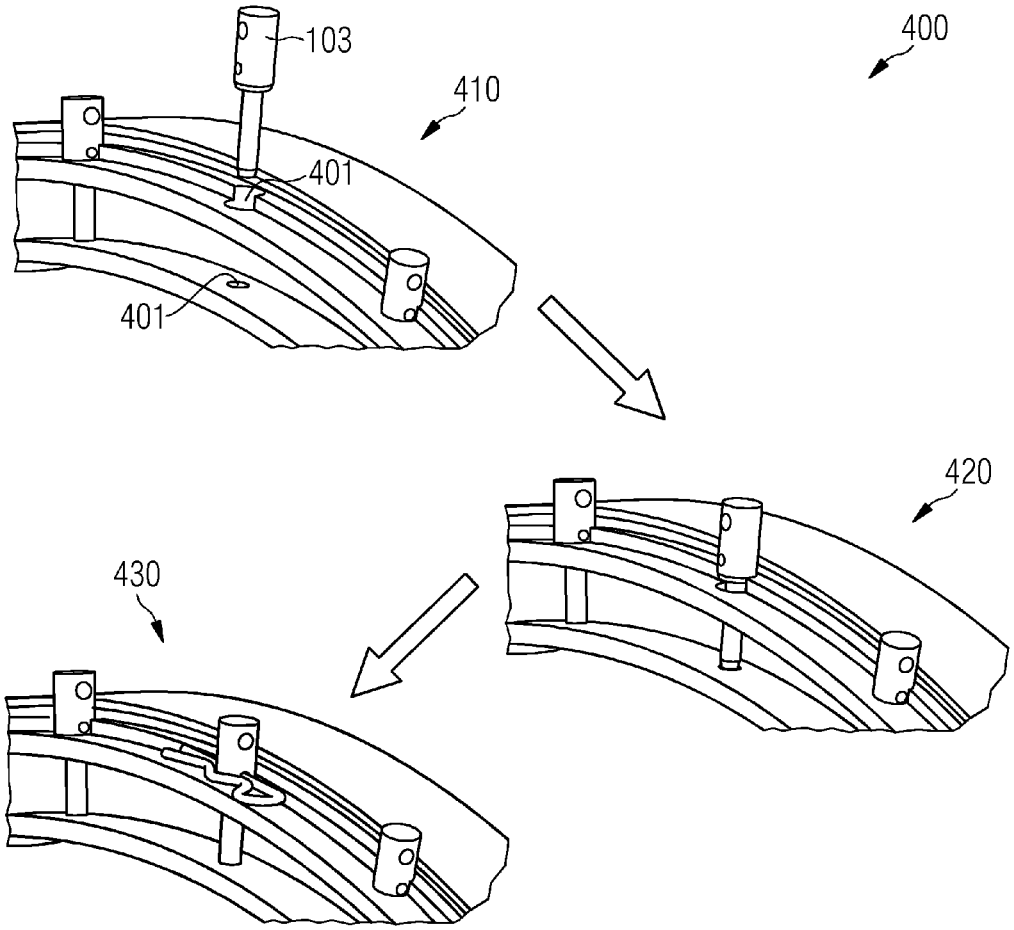
FIG. 6 schematically depicts a method of placing a drive lever pin in a drive lever arrangement according to exemplary embodiment.

In the following, referring to FIG. 6, a method of placing a drive lever pin 103 in a drive lever arrangement 100 according to an exemplary embodiment will be explained. The method comprises as a first step, inserting 410 a drive lever pin 103 into a hole 401 formed in the unison ring 101. In particular, the hole 401 is a throughbore hole which is formed in the bottom rail 210 and the middle rail 211 as well as in the top rail 212. In a second step 420, an end of the shaft part 208 of the drive lever pin 103 engages in the hole of the bottom rail and the head part 207 of the drive lever pin 103 engages in the middle rail. In the third step 430, an R-shaped clip is inserted between the top rail and the middle rail through the throughbore hole 206 of the drive lever pin 103.

Figure 7:
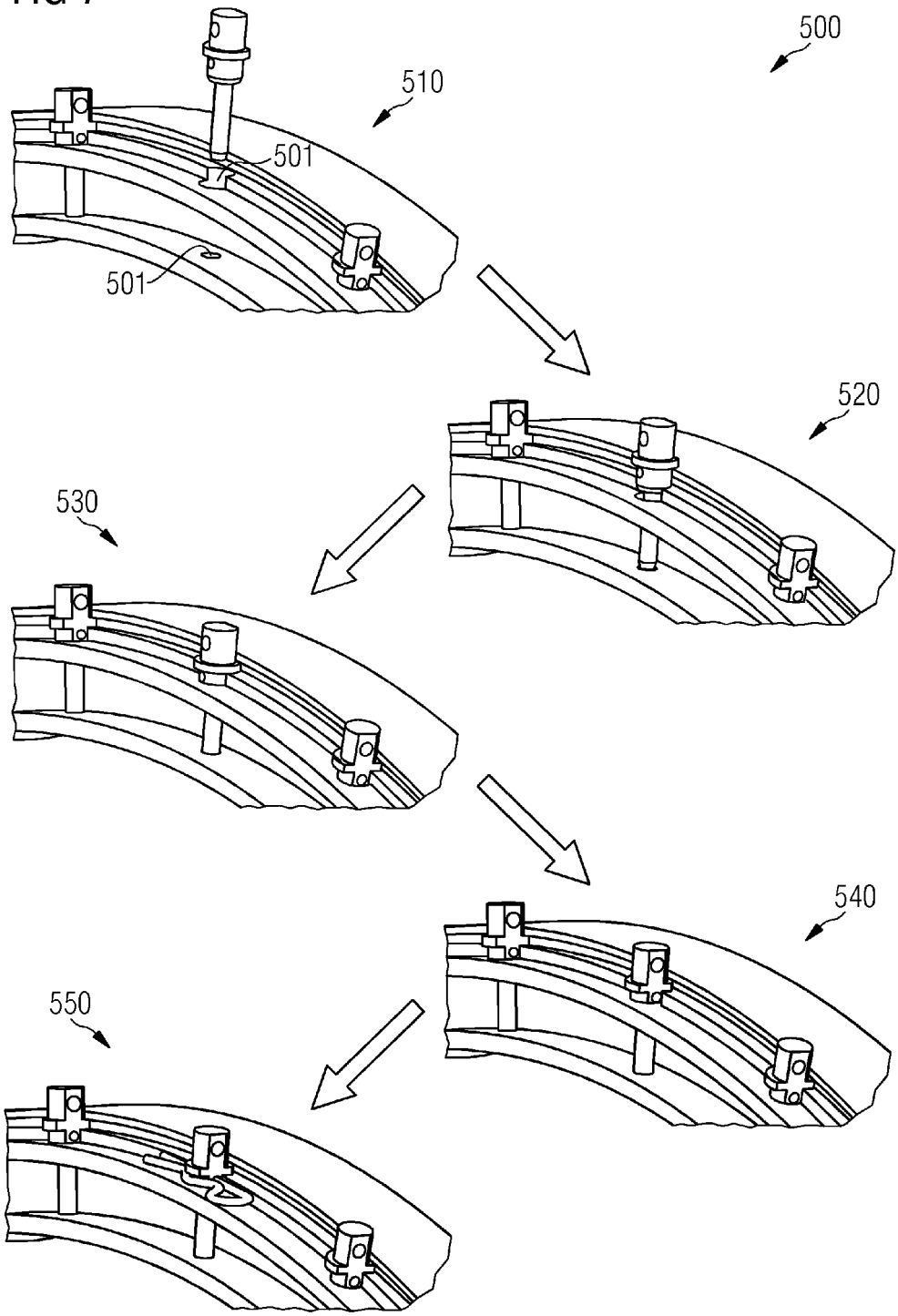
FIG. 7 schematically depicts a method of placing a drive lever pin with a circumferential collar element in a drive lever arrangement according to exemplary embodiment.

In the following, referring to FIG. 7, a method of placing a drive lever pin 301 with a circumferential collar element 304 in a drive lever arrangement 100 according to an exemplary embodiment will be explained. The method comprises as a first step, inserting 510 the drive lever pin 301 into a hole 501 formed in the unison ring 101. In particular, the hole 501 is a throughbore hole which is formed in the bottom rail 210 and the middle rail 211 as well as in the top rail 212. In a second step 520, an end of the shaft part 303 of the drive lever pin 301 engages in the hole of the bottom rail. The head part 302 of the drive lever pin 103 engages in the middle rail in a third step 530. In the fourth step 540, the drive lever pin 310 is rotated by 90 degrees, thus engaging the circumferential collar element in the first groove of the unison ring. In a fifth step an R-shaped clip is inserted between the top rail and the middle rail through the throughbore hole of the drive lever pin 301.

It should be noted that the term "comprising" does not exclude other elements or steps and the "a" or "an" does not exclude a plurality. Also elements described in association with different embodiments may be combined. It should also be noted that reference signs in the claims shall not be construed as limiting the scope of the claims.

The invention claimed is:

1. A drive lever arrangement comprising:
a unison ring which comprises a groove;
a drive lever;
a drive lever pin comprising a transversal throughbore hole, said drive lever pin for connecting the drive lever to the unison ring; and
a clip,
wherein the drive lever pin connects the drive lever to the unison ring, and
wherein the clip is inserted in the groove through the throughbore hole of the drive lever pin, and engages with the groove of the unison ring to inhibit rotation of the drive lever pin, or
wherein the drive lever pin further comprises a circumferential collar element, wherein the circumferential collar element is adapted to engage with the groove, and wherein the clip is inserted through the throughbore hole of the drive lever pin.

2. The drive lever arrangement as claimed in claim 1, wherein the clip comprises a first leg and bent second leg, wherein the first leg and the bent second leg are connected by a spring part.

3. The drive lever arrangement as claimed in claim 2, wherein the bent second leg comprises a first region where a distance between the first leg of the clip and the bent second leg of the clip increases and a second region where the distance between the first leg of the clip and the bent second leg of the clip decreases.

4. The drive lever arrangement as claimed in claim 1,
wherein the unison ring comprises a protrusion extending from a compact portion of the unison ring, and
wherein the protrusion comprises a hole which is adapted in such a way that the drive lever pin is insertable into the hole.

5. The drive lever arrangement as claimed in claim 1,
wherein the drive lever pin comprises a head part, and
wherein the transversal throughbore hole is arranged in the head part of the drive lever pin.

6. The drive lever arrangement as claimed in claim 1,
wherein the circumferential collar element may extend over an angle between 15 degrees and 315 degrees of the perimeter of the drive lever pin.

7. The drive lever arrangement as claimed in claim 1, wherein the drive lever pin comprises an element for turning the drive lever pin.

8. The drive lever arrangement according to claim 1, wherein the clip is a R-shaped clip.

9. A method of placing a drive lever pin in a drive lever arrangement, wherein the drive lever arrangement comprises a unison ring comprising a groove, a drive lever, and a drive lever pin comprising a transversal throughbore hole, said drive lever pin for connecting the drive lever to the unison ring, wherein the method comprises:

connecting the drive lever to the unison ring with the drive lever pin, inserting a clip in the groove through the throughbore hole of the drive lever pin, and inhibiting rotation of the drive lever pin based on the inserting the clip through the throughbore hole of the drive lever pin.

10. The method of placing a drive lever pin in a drive lever arrangement as claimed in claim 9, wherein the drive lever pin comprises a circumferential collar element, the method further comprises:

turning the drive lever pin so that the circumferential collar element of the drive lever pin engages in the groove of the unison ring.

11. The method of placing the drive lever pin in the drive lever arrangement as claimed in claim 9, wherein the throughbore hole of the drive lever pin is perpendicular to a main axis of the drive lever pin.

12. The method of placing the drive lever pin in the drive lever arrangement as claimed in claim 9, wherein the clip includes a bent leg and a straight leg, and wherein the inserting step comprises inserting the straight leg through the throughbore hole of the drive lever pin.

13. The method of placing the drive lever pin in the drive lever arrangement as claimed in claim 12, wherein the clip is a R-shaped clip and wherein the inserting step further comprises angling the bent leg away from the straight leg.

14. The method of placing the drive lever pin in the drive lever arrangement as claimed in claim 12, further comprising gripping an outer perimeter of the drive level pin with the bent leg.

15. The method of placing the drive lever pin in the drive lever arrangement as claimed in claim 9, wherein the connecting step includes inserting the drive lever pin through a throughbore hole in a first rail of the unison ring and inserting the drive lever pin through a throughbore hole in a second rail of the unison ring, wherein the throughbore holes in the first and second rails have different diameters.

16. The method of placing the drive lever pin in the drive lever arrangement as claimed in claim 15, wherein the throughbore hole in the first rail has a larger diameter than the throughbore hole in the second rail and wherein the inserting step comprises engaging a head part of the drive lever pin with the throughbore hole in the first rail and engaging a shaft part of the drive lever pin with the throughbore hole in the second rail, wherein the head part has a larger diameter than the shaft part of the drive lever pin.

* * * * *